US006186642B1

(12) United States Patent
Corcorran et al.

(10) Patent No.: US 6,186,642 B1
(45) Date of Patent: Feb. 13, 2001

(54) ON-SITE FABRICATED LINEAR AMBIENT LIGHTING SYSTEM

(75) Inventors: Sean M. Corcorran, Palo Alto, CA (US); Angela R.M. Nahikian, Ada, MI (US); David M. Webster, San Mateo, CA (US)

(73) Assignee: Steelcase Inc., Grand Rapids, MI (US)

( * ) Notice: Under 35 U.S.C. 154(b), the term of this patent shall be extended for 0 days.

(21) Appl. No.: 09/266,977

(22) Filed: Mar. 12, 1999

(51) Int. Cl.[7] ..... F21S 4/00

(52) U.S. Cl. ..... 362/219; 362/223; 362/147; 362/260; 362/217

(58) Field of Search ..... 362/147, 260, 362/217, 219, 221, 222, 223, 225

(56) References Cited

U.S. PATENT DOCUMENTS

| | | | | |
|---|---|---|---|---|
| D. 307,639 | | 5/1990 | Lettenmayer | D26/24 |
| D. 352,566 | | 11/1994 | Johnson et al. | D26/88 |
| 2,259,151 | | 10/1941 | Claspy . | |
| 2,465,141 | | 3/1949 | Wakefield | 362/219 |
| 2,493,415 | | 1/1950 | Navin . | |
| 2,525,315 | | 10/1950 | Schepmoes . | |
| 2,932,728 | | 4/1960 | Thomas . | |
| 2,988,633 | | 6/1961 | Rosenfield | 362/219 |
| 2,990,470 | | 6/1961 | Bodian et al. | 362/219 |
| 3,375,322 | | 3/1968 | Serio et al. | 362/219 X |
| 3,409,262 | | 11/1968 | Soule | 362/225 X |
| 3,529,461 | | 9/1970 | Knudson . | |
| 4,580,200 | * | 4/1986 | Hess et al. | 362/260 X |
| 4,656,878 | | 4/1987 | Addison | 72/181 |
| 4,712,165 | | 12/1987 | Cetrone | 362/147 |
| 4,748,547 | * | 5/1988 | Baker | 362/217 X |
| 4,858,087 | * | 8/1989 | Hartshorn | 362/260 X |
| 4,866,584 | | 9/1989 | Plewman | 362/225 |
| 4,899,566 | | 2/1990 | Knudson | 72/129 |
| 4,939,627 | * | 7/1990 | Herst et al. | 362/147 X |
| 5,111,370 | * | 5/1992 | Clark | 362/147 |
| 5,186,537 | | 2/1993 | Katoh et al. | 362/347 |
| 5,371,661 | | 12/1994 | Simpson | 362/220 |
| 5,394,722 | | 3/1995 | Meyer | 72/129 |
| 5,551,272 | | 9/1996 | Knudson | 72/181 |
| 5,658,066 | | 8/1997 | Hirsch | 362/219 |
| 5,709,460 | | 1/1998 | Lester | 362/147 |
| 5,740,687 | | 4/1998 | Meyer et al. | 72/131 |
| 5,823,656 | * | 10/1998 | Waldmann | 362/223 X |
| 5,865,528 | * | 2/1999 | Compton et al. | 362/260 X |
| 5,884,994 | * | 3/1999 | Herst et al. | 362/260 X |

* cited by examiner

*Primary Examiner*—Laura K. Tso
(74) *Attorney, Agent, or Firm*—Price, Heneveld, Cooper, DeWitt & Litton

(57) ABSTRACT

A linear ambient lighting system is adapted for on-site fabrication in open building plans and the like. The lighting system includes a plurality of elongated lighting elements having electrical power sockets at the opposite ends thereof to physically support the lighting elements and electrically connect the same with electrical connectors to supply electrical power to the lighting elements. Fixture supports are connected with and support the electrical power sockets and are configured to be spaced longitudinally along the length of the associated lighting fixture. Fixture hangers are provided with first portions connected with an overhead support portion of an associated building, and second portions connected with and supporting the fixture supports. Structural supports extend between and connect the fixture supports. An elongated cover is connected with the light fixture, and has an uninterrupted one-piece construction and a selected length that extends continuously along the entire length of the associated lighting fixture below a lowermost portion thereof, to provide a rigid lightweight assembly that has a neat, custom one-piece appearance and can be fabricated on-site at the associated building to alleviate transportation damage and cost.

45 Claims, 5 Drawing Sheets

ON-SITE FABRICATED LINEAR AMBIENT LIGHTING SYSTEM

CROSS-REFERENCE TO RELATED APPLICATIONS

The present application is related to commonly assigned, copending U.S. patent application Ser. No. 09/267,314, entitled ON-SITE FABRICATED LINEAR AMBIENT LIGHTING SYSTEM filed on even date herewith.

BACKGROUND OF THE INVENTION

The present invention relates to ambient lighting systems and the like, and in particular to an on-site fabricated linear lighting system.

Linear ambient lighting systems are used in a wide variety of building construction applications. The linear lights or fixtures typically include a cover for shielding direct lighting, an elongated lighting element, and some kind of supporting structure for suspending the lighting system above the floor of an associated building.

Heretofore, linear lighting systems have normally incorporated multiple separate lighting units or fixtures that are positioned end-to-end to form a single elongate linear light. These lighting units are usually suspended from the ceiling and may be fastened together end-to-end. Such lighting units are normally prefabricated before reaching the construction site. More specifically, the lighting units are preassembled at their place of manufacture, such that the lighting units are complete with a cover and other associated components prior to shipping. This method of construction and application typically results in a large number of light fixtures being damaged during shipping. In addition, the use of multiple lighting units to form a single linear light affords an inefficient installation process and an unattractive overall appearance, since the light has a distinctive segmented look, instead of the desired one-piece custom appearance. The appearance of such lighting is quite important when the building space is being used for offices, meeting rooms, and the like. The increased popularity of open office plans has created a need for attractive linear lighting systems that can be manufactured and installed quickly and economically.

While some types of linear ambient lighting systems use prefabricated elongated assemblies which are ready to hang as a unit, such products are generally by nature very long, and therefore fragile and expensive to ship long distances. In addition, lighting fixtures much beyond 8 feet in length are difficult, if not impossible, to transport into existing buildings without first removing windows. While cranes are often employed in high rise constructions to lift linear lighting equipment through upper floor window openings, such installation processes increase cost, time, and potential fixture damage.

SUMMARY OF THE INVENTION

One aspect of the present invention is to provide a linear ambient lighting system adapted for on-site fabrication in open building plans and the like. The lighting system includes a plurality of elongated lighting elements having electrical power sockets at the opposite ends thereof to physically support the lighting elements and electrically connect the same with electrical connectors to supply electrical power to the lighting elements. Fixture supports are connected with and support the electrical power sockets and are configured to be spaced longitudinally along the length of the associated lighting fixture. Structural supports extend between and connect the fixture supports. Fixture hangers are provided with first portions connected with an overhead support portion of an associated building, and lower portions connected with and supporting the fixture supports. An elongated cover is connected with the light fixture, and has an uninterrupted one-piece construction and a selected length that extends continuously along the entire length of an associated lighting fixture below a lowermost portion thereof, to provide a rigid lightweight assembly that has a neat, custom one-piece appearance and can be fabricated on-site at the associated building to alleviate transportation damage and cost.

Another aspect of the present invention is to provide a method for making linear ambient lighting on-site for open building plans and the like. The method includes providing a plurality of elongated lighting elements that have electrical connectors positioned adjacent to the opposite ends thereof, providing a plurality of electrical power sockets that are shaped to receive the opposite ends of the lighting elements therein to physically support the same and connect with the electrical connectors to supply electrical power to the lighting elements, providing a plurality of fixture supports shaped for connection with the electrical power sockets and configured to be spaced longitudinally along the length of an associated lighting fixture, providing a plurality of structural supports extending between and connecting the fixture supports, and providing a plurality of fixture hangers. The method further includes connecting a first portion of each of the fixture hangers to an overhead portion of an associated building in a mutually linear relationship, mounting the fixture supports on a second portion of each of the fixture hangers, assembling the electrical power sockets on the opposite ends of the lighting elements to define lighting assemblies, positioning the light assemblies between laterally adjacent pairs of the fixture supports and connecting the same thereto, constructing on-site at the associated building an elongated housing to a selected length that extends continuously along an entire length of the lighting fixture, and covering the light fixture with the cover such that the cover is attached to the lighting fixture below a lowermost portion thereof thereby defining a rigid lightweight assembly that has a neat, custom one-piece appearance and can be fabricated on-site at the associated building to alleviate transportation damage and cost.

Yet another aspect of the present invention is to provide a linear ambient lighting system kit. The lighting kit includes fixture supports that are adapted to connect with and support electrical power sockets normally associated with linear lighting fixtures, said fixture supports adapted to be spaced longitudinally along the length of the associated lighting fixture. At least two structural support bars extend between and are substantially juxtaposed about the associated lighting fixture. Fixture hangers are provided with first portions connected with an overhead support portion of an associated building, and second portions connected with and supporting the fixture supports. An elongated cover is adapted to connect with the lighting system and has an uninterrupted one-piece construction that is constructed on-site having a selected length that extends continuously along the entire length of the associated lighting fixture. Connectors are adapted to attach the cover to at least one of a group consisting of the fixture supports and the structural support bars, thereby defining a rigid lightweight assembly that has a neat, custom one-piece appearance and can be fabricated on-site at the associated building to alleviate transportation damage and cost.

The principle objects of the present invention are to provide a linear ambient lighting system adapted for on-site fabrication in open building plans and the like. The utilization of a cover having an uninterrupted one-piece construction formed on-site provides a lighting system with a neat, custom one-piece appearance aiding in the aesthetics of the application. In addition, on-site fabrication and assembly of the lighting system reduces costs associated with transportation and damage normally associated with shipping and installing prefabricated light assemblies. The lighting system has an uncomplicated, lightweight construction that reduces manufacturing, fabrication and installation costs and difficulty.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
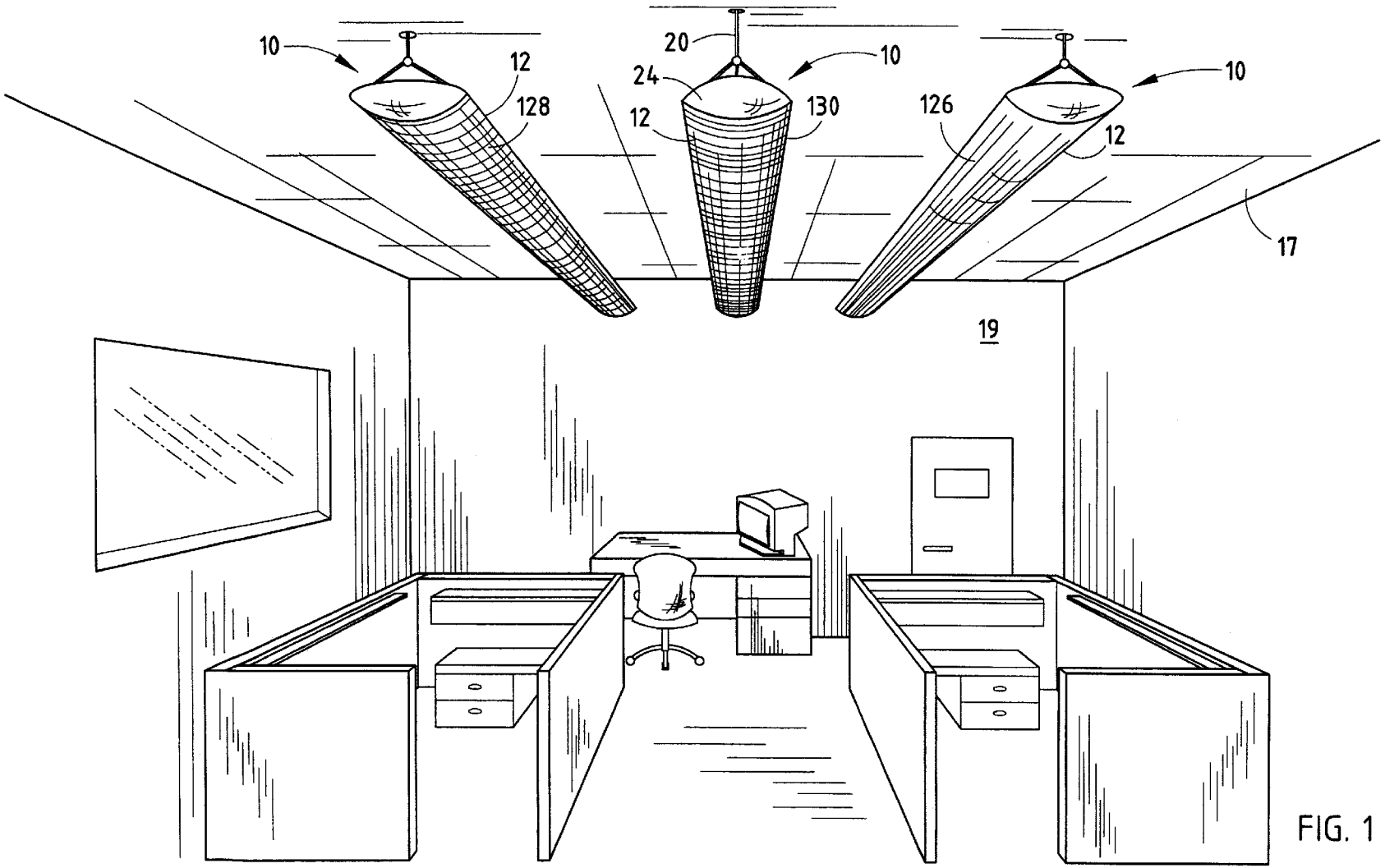
FIG. 1 is a perspective view of three linear ambient lighting systems embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIGS. 1 and 2*a*) generally designates a linear ambient lighting system embodying the present invention. In the illustrated example, the lighting system 10 includes a plurality of elongated lighting elements 14 having electrical power sockets 16 connected at the opposite ends thereof to physically support the lighting elements 14 and electrically connect the same with a series of electrical connectors 15 (FIG. 2*b*) that supply electrical power to the lighting elements 14. A plurality of fixture supports 18 are connected with and support the electrical power sockets 16, and are configured to be spaced longitudinally along the length of the associated lighting system 10. A plurality of structural supports 23 extend between and connect the fixture supports 18. A plurality of fixture hangers 20 are provided with first portions 62 connected with an overhead support portion 17 (FIG. 1) of an associated building 19, and second portions 64 that connect with and support fixture supports 18. An elongated cover 12 is connected with the lighting system 10 and has an uninterrupted one-piece construction and a selected length that extends continuously along the entire length of an associated lighting system 10 below a lowermost portion thereof to provide a rigid lightweight assembly that has a neat, custom one-piece appearance and can be fabricated on-site at the associated building to alleviate transportation damage and cost.

In the illustrated example, lighting elements 14 are fluorescent, elongated tube-style bulbs, such as those normally used in indirect linear lighting systems, although it is noted that other types and styles of lighting elements may be substituted. Each lighting element 14 is provided with electrical connectors 15 on the opposite ends thereof and of a type normally associated with fluorescent lighting tubes.

The illustrated power sockets 16 are provided with a ballast section 40 and an upper section 41. The ballast section 40 is defined by a generally flat downwardly facing surface 42, and generally flat side surfaces 44, although other geometrical configurations of the power sockets 16 may be employed. The upper sections 41 of power sockets 16 are adapted to support electrical connectors 15 therein such that lighting elements 14 can be mounted within power sockets 16 thereby allowing electrical connectors 15 to connect with and supply electrical power to lighting elements 14.

Figures 2A, 2B:
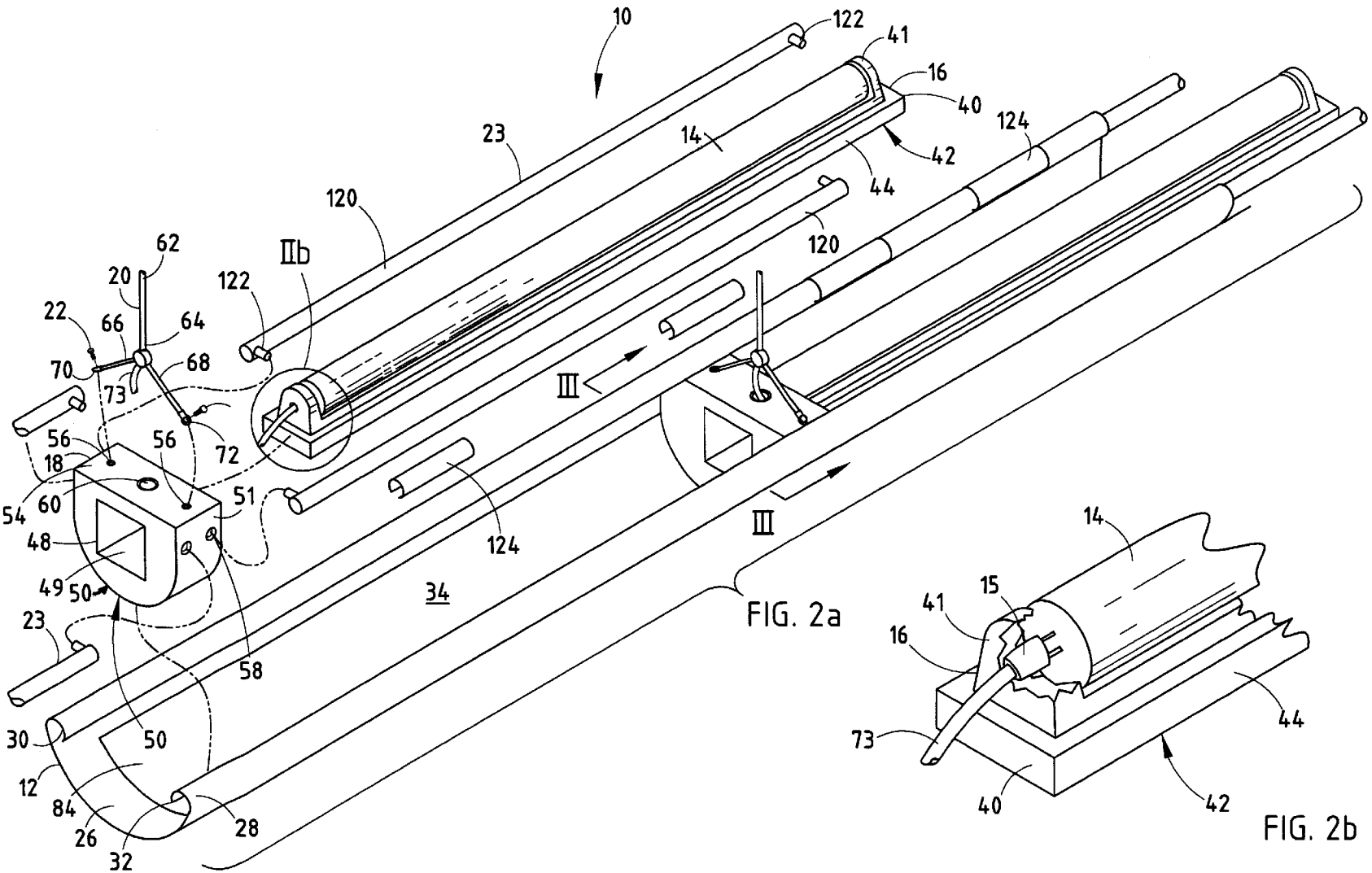
FIG. 2*a* is an exploded perspective view of the linear ambient lighting system embodying the present invention.
FIG. 2*b* is an enlarged partial cross-sectional view of a power socket and lighting element taken of area II*b*, FIG. 2*a;*
Figure 3:
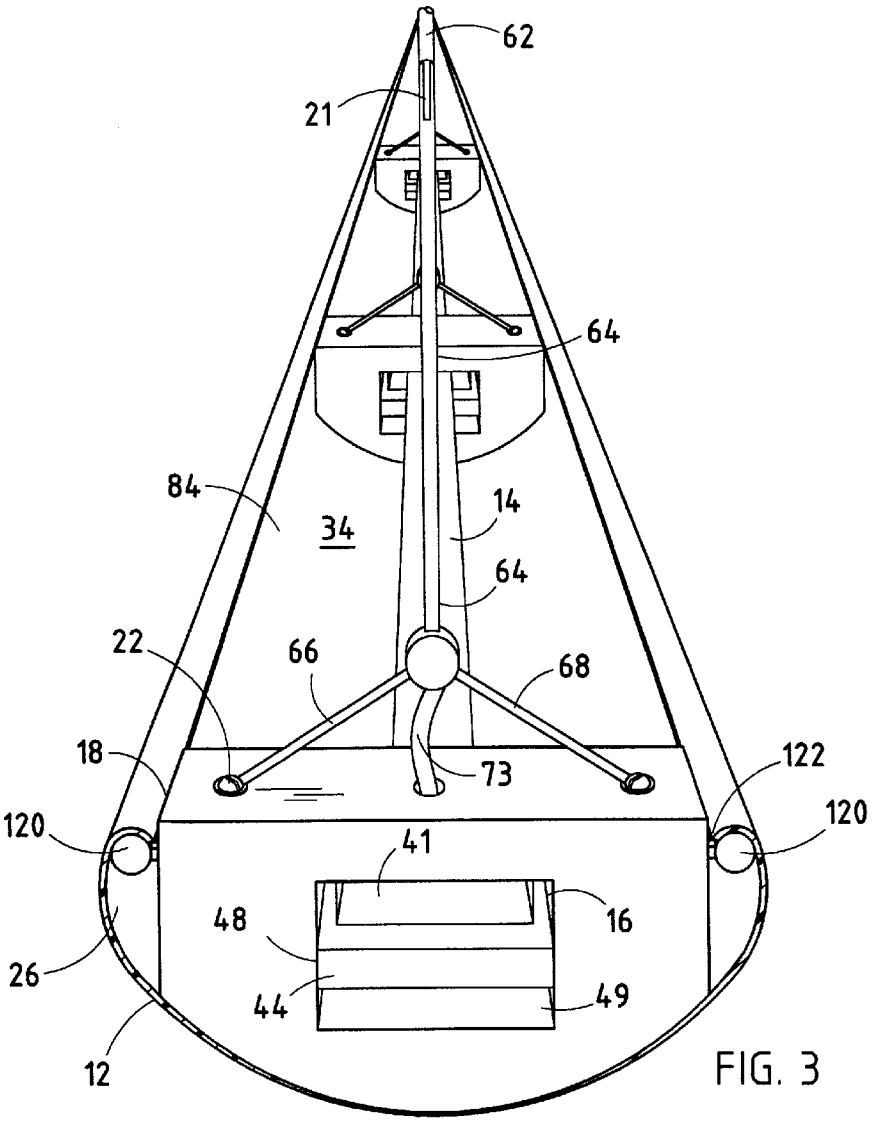
FIG. 3 is a cross-sectional perspective view of the lighting system, taken along line III—III, FIG. 2*a;*

The fixture supports 18 shown in FIGS. 2*a* and 3 have a generally ring-shaped side-elevational shape and are provided with an aperture 48 having support wall 49. Aperture 48 of each fixture support 18 has a generally rectangular shape, however, other geometrical shapes corresponding to the geometrical shape of the power sockets 16 may be employed. Each fixture support 18 is defined by an arcuately shaped, downwardly facing marginal surface 50, side surfaces 51, and generally flat, horizontally oriented, upwardly facing marginal surface 54, having two threaded apertures 56 located therein. Each fixture support 18 is further provided with a wire aperture 60 centrally located within marginal surface 54 and extending to aperture 48, and a pair of mounting apertures 58 located in an upper portion of each side surface 51.

The structural supports 23 comprise two structural support bars or support rods 120 extending longitudinally along the lighting system 10. Rods 120 are provided with integrally formed mounting pins 122 extending radially outward from opposite ends of each rod 120. Mounting pins 122 are adapted to be press fit with apertures 58 of fixture supports 18.

In the example illustrated in FIGS. 2*a* and 3, fixture hangers 20 are each provided with first portion 62 that is connected with the overhead support portion 17 of the associated building 19 and second portion 64 that flares into a first connector half 66 and a second connector half 68. The first connector half 66 and the second connector half 68 of each hanger 20 are provided with an eyelet 70 having a centrally located aperture 72 therein. Each hanger 20 has a hollow interior 21 in which electrical conductors, such as wires 73, are routed so as to provide electrical power from an electrical source (not shown) to the electrical power sockets 16.

The illustrated cover 12 (FIGS. 2*a* and 2*b*) is constructed as a single unit, having an uninterrupted one-piece construction and a selected length that extends continuously along the entire length of the lighting system 10. Cover 12 is defined by an upper surface 26 and a lower surface 28 and has a generally upwardly curved trough shape and an arcuate lateral cross-sectional shape. Cover 12 is provided with a first inwardly turned side edge 30 and a second inwardly turned side edge 32. Edges 30 and 32 are laterally spaced apart to define therebetween an upwardly opening window 34. First edge 30 and second edge 32 of cover 12 are adapted to wrap around and engage rods 120 thereby securing cover 12 to lighting system 10.

Figures 5A, 5B:
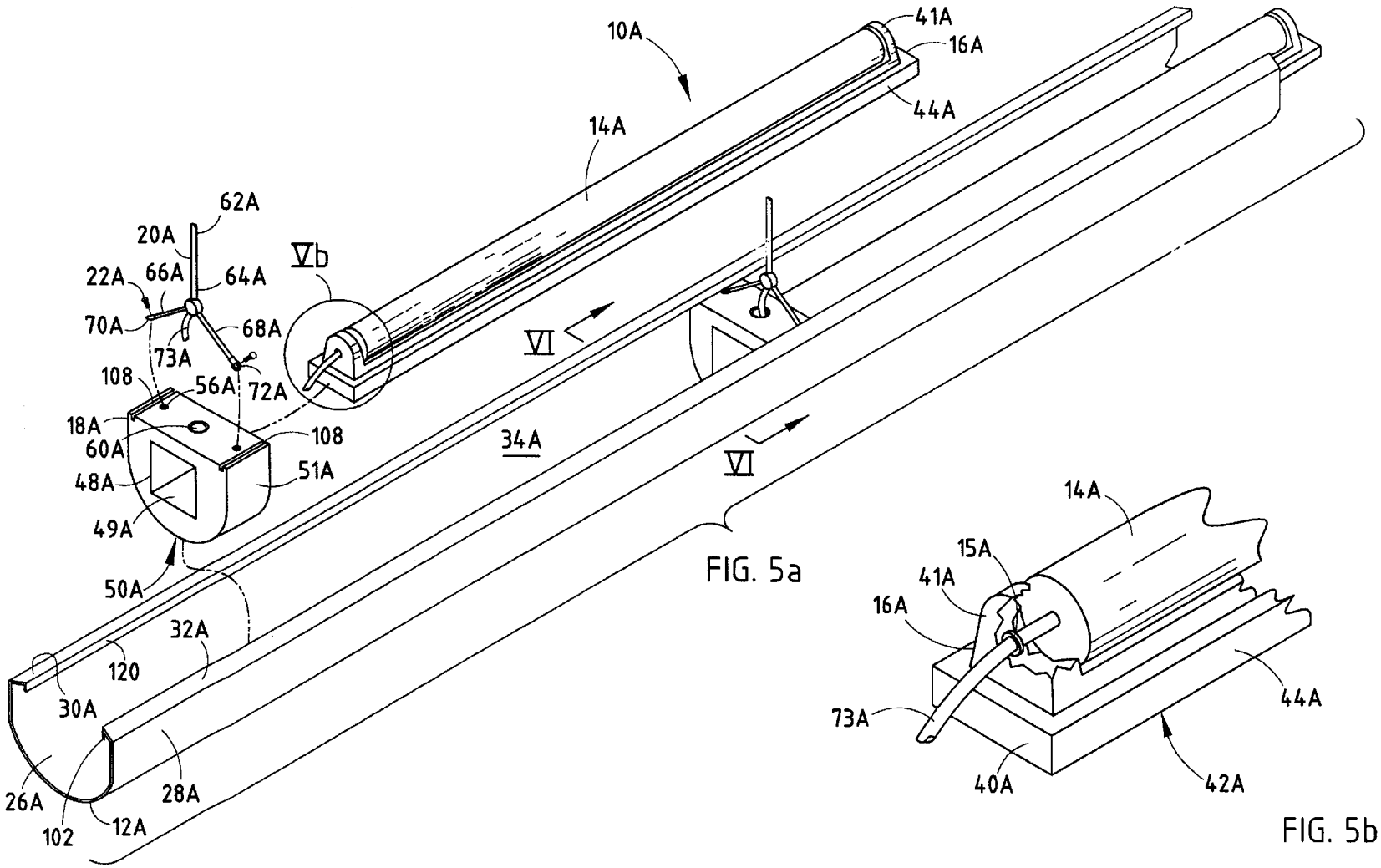
FIG. 5*a* is an exploded perspective view of a first alternate embodiment of the lighting system.
FIG. 5*b* is an enlarged partial cross-sectional view of a power socket and a lighting element taken of area V*b*, FIG. 5*a;*
Figure 6:
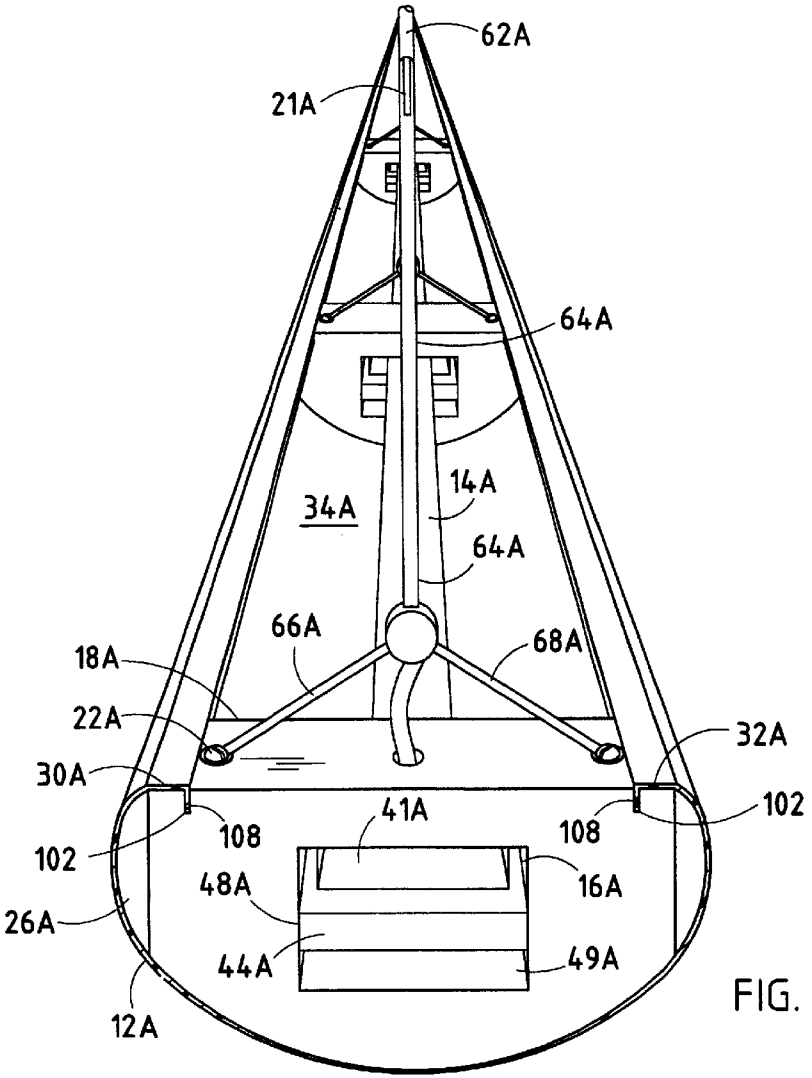
FIG. 6 is a cross-sectional perspective view of the first alternate embodiment of the lighting system, taken along line VI—VI, FIG. 5*a*.

Cover 12 may be constructed of a wide-array of materials, including fabrics (FIGS. 2*a* and 3), light metals (FIGS. 5*a* and 6), plastics 126 (FIG. 1), and composites. When constructed of fabric, cover 12 is cut and shaped on-site from a single bolt of material. Cover 12 may be coated with an adhesive and attached directly to the support rods 120 and/or the fixture supports 18. In addition, a plurality of clips 124 adapted to engage the support rods 120 and fasten cover 12 thereto, may be employed. Further, cover 12 may be formed from a wire mesh 128 (FIG. 1) or a plastic mesh 130 (FIG. 1). When constructed of metal, cover 12 is preferably formed using commonly known roll forming techniques for shaping continuous extrusions of sheet metal and is formed on the construction site itself, preferably by a portable type of roll forming machine. Using the roll forming techniques, the cover 12 would normally be formed from a coiled strip of sheet metal (not shown), although it is noted that other suitable materials may be used. When constructed of plastics, cover 12 may be formed as a flexible or simi-rigid construction at an off-site location and transported to the building site in roll form. At the site, the material can simply be unrolled and attached to the lighting system 10, or cut and formed on-site to fit the appropriate application if not already configured for that application.

Upper surface 26 of cover 12 is naturally light reflective, although it is noted that upper surface 26 can be coated with a light reflective substance after the construction thereof. In addition, upper surface 26 of cover 12 can be provided with a reflective material that is formed with or co-extruded with cover 12 depending upon the material used to construct cover 12. Alternatively, a reflector 84 may be positioned between cover 12 and lighting elements 14. In the illustrated example, reflector 84 is constructed as a single piece extending along the entire distance of the lighting system 10, however, reflector 84 may also be constructed as a plurality of pieces extending between fixture supports 18.

Figure 4:
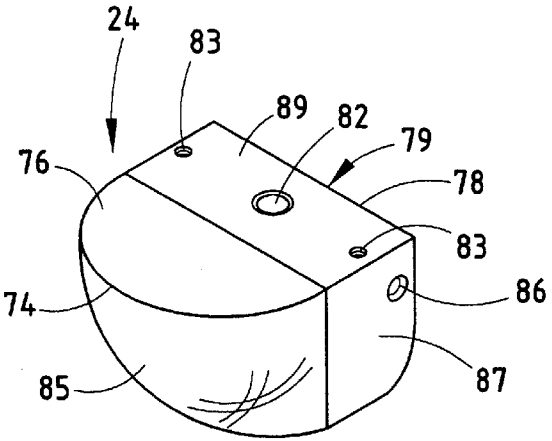
FIG. 4 is a perspective view of an end cap.

Lighting system 10 is further provided with end caps 24 (FIG. 4) having a hollow, arcuately shaped body that includes an arcuate end 74 and a mounting end 78. Arcuate end 74 has a downwardly facing arcuate surface 85 and a substantially flat top surface 76. Mounting end 78 has a substantially flat end surface 79, side surfaces 87, and an upwardly facing marginal surface 89. Arcuate surface 85 of each end cap 24 is provided with a finished surface that adds to the overall aesthetic appeal of the lighting system 10. Mounting end 78 of each end cap 24 is provided with an aperture (not shown) similar to aperture 48 of fixture supports 18 for mount power sockets therein. Mounting end 78 of each end cap 24 is further provided with a wire aperture 82 extending between marginal surface 89 and the aperture (not shown), two threaded apertures 83 extending into marginal surface 89, and an aperture 86 extending into each side surface 87.

In construction and assembly, the cover 12 (FIGS. 2*a* and 3) can be formed to fit any length application desired. After determining the length of the desired light fixture by considering factors such as the length of the room, the spacing of any overhead support structures 17, and the length of the lighting elements 14, the cover 12 is constructed on-site using any method appropriate for the material chosen. This on-site fabrication of the cover allows customized fitting of the lighting system 10 to the particular application, thus resulting in a lighting system 10 having a clean, single-unit appearance. This is more suitable for certain applications, such as office settings having an open floor plan.

After construction of cover 12, power sockets 16 are electrically connected with the electrical connectors 15 of each lighting element 14. Power sockets 16 are then connected to the fixture supports 18 by inserting a portion of each power socket 16 within the aperture 48 of each fixture support 18. Support bars 120 are assembled with fixture supports 18 by press fitting mounting pins 122 within mounting apertures 58 thereby structurally reinforcing lighting system 10. Alternatively, mounting pins 122 may be replaced with mechanical fasteners such as screws or bolts that extend through support bars 120 and threadably engage within apertures 58 of fixture supports 18. Fixture hangers 20 are connected to fixture supports 18 by way of connectors 22 inserted through apertures 72 of eyelets 70 and threadably engaged within apertures 56 of fixture supports 18. Connectors 22 are mechanical fasteners, such as the illustrated machine screws, although other forms of fasteners may be used including, but not limited to, bolts and nuts, rivets, and clips with release pins. Electrical wires 73 are in electrical communication with power sockets 16. If a separate reflector 84 is used in place of a light reflective upper surface 26 of cover 12, reflector 84 is placed within cover 12. Cover 12 is then assembled with lighting system 10 by placing the lighting system 10 within cover 12 such that marginal surface 50 of each fixture support 18 is in substantial contact with upper surface 26 of cover 12. If a flexible material is used to construct cover 12, adhesive may be applied to the upper surface 26 of cover 12 and the cover 12 then adhered to the support bars 120 and/or the fixture supports 18. In addition, clips 124 may be fastened about cover 12 and support bars 120. If a semi-rigid material is used to construct cover 12, the edges 30 and 32 of cover 12 may be wrapped around support bars 120 thereby securing cover 12 to the lighting system 10. End caps 24 are connected with fixture hangers 20 and cover 12 in a manner similar to fixture supports 18.

After assembly, the entire lighting system 10 can be raised to the appropriate above ground level and the first portion 62 of each hanger 20 is attached to the overhead support portion 17 of the associated building 19 (FIG. 1). While the illustrated example shows the ceiling portion of the building 19 as the overhead support portion 17, any overhead portion of the building 19 may be substituted including but not limited to structural supports of the building and the walls associated therewith. The result is an easy to assemble and install light fixture that is aesthetically compatible with today's building requirements.

In operation, indirect ambient lighting is provided when light emitted from each lighting element 14 is reflected upwardly from the upper surface 26 of cover 12, or reflector 84, and outwardly through window 34.

The reference numeral 10A (FIG. 5*a*) generally designates another embodiment of the present invention. Since the lighting system 10A is similar to the previously described lighting system 10, similar parts appearing in FIGS. 2*a*, 2*b*, 3 and 4, and FIGS. 5, 5*b*, 6 and 7, respectively, are represented by the same corresponding reference numeral, except for the suffix "A" in the numerals of the latter.

Power sockets 16A (FIGS. 5*a*, 5*b*, and 6) are similar in shape to power sockets 16 of lighting system 10. The ballast sections 40A is defined by a generally flat downwardly facing surface 42A, and generally flat side surfaces 44A, although other geometrical configurations of the power sockets 16A may be employed. Upper sections 41A of power sockets 16A are adapted to support electrical connectors 15A therein such that lighting elements 14A can be mounted within power sockets 16A thereby allowing electrical connectors 15A to connect with and supply electrical power to lighting elements 14A.

Fixture supports 18A are similar in shape to fixture supports 18 of lighting system 10. Each fixture support 18A is provided with a pair of downwardly extending notches 108 located within marginal surface 54A. Marginal surface 54A is further provided with a centrally located wire aperture 60A extending between marginal surface 54A and aperture 48A.

Cover 12A is similar in construction and shape to cover 12 of lighting system 10. Cover 12A is further provided with downwardly turned flanges 102 linearly extending along the length of the edges 30A and 32A.

Figure 7:
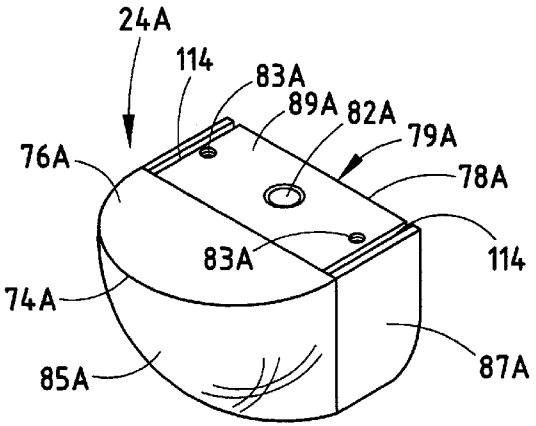
FIG. 7 is a perspective view of an alternate embodiment of the end cap.

End caps 24A, as illustrated in FIG. 7, are similar in shape to end caps 24 of lighting system 10. Each end cap 24A is provided with a pair of downwardly extending notches 114 within marginal surface 87A. Marginal surface 87A of each end cap 24A is provided with a centrally located aperture 82A extending between marginal surface 87A and the centrally located aperture (not shown) of end cap 24A, similar to aperture 48A of fixture supports 18A.

Lighting system 10A (FIGS. 5*a* and 6) is constructed and assembled similar to the lighting system 10 (FIGS. 2*a* and 3). After construction of cover 12A, power sockets 16A are electrically connected with electrical connectors 15A of each lighting element 14A. Power sockets 16A are then connected to the fixture supports 18A by inserting a portion of each power socket 16A within aperture 48A of each fixture support 18A. Fixture hangers 20A are connected to fixture supports 18A by way of connectors 22A, similar to the assembly of lighting system 10. Electrical wires 73A are in electrical communication with power sockets 16A. Cover 12A is then assembled with lighting system 10A by placing the lighting system 10A within cover 12A such that marginal surface 50A of each fixture support 18A is in substantial contact with upper surface 26A of cover 12A. Cover 12A is then flexed and positioned about fixture supports 18A such that flanges 102 of cover 12A extend into and are held within notches 108 of fixture supports 18A thereby holding fixture supports 18A with cover 12A.

After assembly, the entire lighting system 10A may be raised to the appropriate above ground level and the first portion 62A of each fixture hanger 20A can be attached to the overhead support portion 17 of the associated building 19 (FIG. 1). While the illustrated example shows the ceiling portion of the associated building 19 as the overhead support portion 17, any overhead portion of the building 19 may be substituted including but not limited to structural supports of the building and the walls associated therewith. The result is an easy to assemble light fixture that is aesthetically compatible with today's building requirements.

In operation, indirect ambient lighting is provided when light emitted from each lighting element 14A is reflected upwardly from the light reflective upper surface 26A of cover 12A and outwardly through window 34A.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A linear ambient lighting system adapted for on-site fabrication in open building plans and the like, comprising:

a plurality of elongated lighting elements having electrical connectors positioned adjacent opposite ends thereof;

a plurality of electrical power sockets shaped to receive the opposite ends of said lighting elements therein to physically support the same and electrically connect with said electrical connectors to supply electrical power to said lighting elements;

a plurality of fixture supports connected with and supporting said electrical power sockets and configured to be spaced longitudinally along the length of an associated lighting fixture;

a plurality of structural supports extending between and connecting said fixture supports;

a plurality of fixture hangers having first portions thereof connected with an overhead support portion of an associated building and second portions thereof connected with and supporting said fixture supports; and an elongated cover connected with said lighting fixture, said cover including opposite side edges laterally spaced apart when said cover is connected to said structural supports to define an upwardly opening window through which light from said lighting elements is emitted from said lighting fixture, said cover having an uninterrupted one-piece construction and a selected length that extends continuously along the entire length of said lighting fixture below a lowermost portion thereof to provide a rigid lightweight assembly that has a neat, custom one-piece appearance and can be fabricated on-site at the associated building to alleviate transportation damage and cost.

2. A lighting system as set forth in claim 1, wherein:

said fixture supports include downwardly facing marginal surfaces; and said cover contacts said downwardly facing marginal surfaces of said fixture supports thereby providing a structural shape to said cover.

3. A lighting system as set forth in claim 2, wherein:

said structural supports are shaped to support and provide a structural shape to said cover.

4. A linear ambient lighting system adapted for on-site fabrication in open building plans and the like, comprising:

a plurality of elongated lighting elements having electrical connectors positioned adjacent opposite ends thereof;

a plurality of electrical power sockets shaped to receive the opposite ends of said lighting elements therein to physically support the same and electrically connect with said electrical connectors to supply electrical power to said lighting elements;

a plurality of fixture supports connected with and supporting said electrical power sockets and configured to be spaced longitudinally along the length of an associated lighting fixture, said fixture supports including downwardly facing marginal surfaces;

a plurality of structural supports extending between and connecting said fixture supports, said structural supports shaped to support and provide a structural shape to said cover, said structural supports including at least two support rods extending longitudinally along and substantially juxtaposed about said lighting elements;

a plurality of fixture hangers having first portions thereof connected with an overhead support portion of an associated building and second portions thereof connected with and supporting said fixture supports; and an elongated cover connected with said lighting fixture, contacting said downwardly facing marginal surfaces of said fixture supports thereby providing a structural shape to said cover, and having an uninterrupted one-piece construction and a selected length that extends continuously along the entire length of said lighting fixture below a lowermost portion thereof to provide a rigid lightweight assembly that has a neat, custom one-piece appearance and can be fabricated on-site at the associated building to alleviate transportation damage and cost.

5. A lighting system as set forth in claim 4, wherein:

said downwardly facing marginal surfaces of said fixture supports have a nonlinear profile.

6. A lighting system as set forth in claim 5, further comprising:

at least one reflector positioned between said cover and said lighting elements.

7. A lighting system as set forth in claim 6, wherein:

said fixture hangers have a hollow interior in which electrical conductors are routed to provide electrical power to said lighting elements.

8. A lighting system as set forth in claim 7, wherein:

said downwardly facing marginal surfaces of said fixture supports have a curved downwardly-convex shape.

9. A lighting system as set forth in claim 8, wherein:

said fixture supports are provided with downwardly extending notches adjacent upper marginal portions of said fixture supports wherein a portion of said cover is closely received therein to connect said cover with said fixture supports without separate fasteners.

10. A lighting system as set forth in claim 9, wherein:

said fixture supports have upwardly facing marginal surfaces in which said notches are disposed.

11. A lighting system as set forth in claim 10, wherein:

said upwardly facing marginal surfaces of said fixture supports are generally flat and horizontally oriented; and said notches of said fixture supports are oriented at an angle to said upwardly facing marginal surfaces of said fixture supports.

12. A lighting system as set forth in claim 11, wherein:

said cover is constructed of a flexible material.

13. A lighting system as set forth in claim 12, wherein:

said cover is constructed of a single piece of plastic film.

14. A lighting system as set forth in claim 11, wherein:

said cover is constructed of a semi-rigid material.

15. A lighting system as set forth in claim 14 wherein:

said cover is constructed of a plastic or material displaying similar properties thereto.

16. A lighting system as set forth in claim 15, wherein:

said cover is constructed of a single piece of plastic mesh.

17. A lighting system as set forth in claim 14, wherein:

said cover is constructed of a single piece of wire mesh.

18. A lighting system as set forth in claim 11, wherein:

said cover is constructed of a rigid material.

19. A lighting system as set forth in claim 18, wherein:

said cover is formed from a coiled strip of sheet metal.

20. A lighting system as set forth in claim 19, wherein:

said cover is roll formed from a coiled strip of sheet metal.

21. A lighting system as set forth in claim 8, wherein:

said cover is connected to said support rods.

22. A lighting system as set forth in claim 21, wherein:

said cover is formed of a semi-rigid material.

23. A lighting system as set forth in claim 22, wherein:

said cover is provided with side edges having longitudinally extending flanges configured to engage said support rods thereby connecting said cover with said light fixture.

24. A lighting system as set forth in claim 1, wherein:

said cover is provided an upper reflective surface.

25. A lighting system as set forth in claim 1, wherein:

said lighting elements comprise florescent tubes.

26. A lighting system as set forth in claim 1, wherein:

end caps are mounted on opposite ends of said lighting fixture.

27. A lighting system as set forth in claim 1, including:

at least one reflector positioned between said cover and said lighting elements.

28. A lighting system as set forth in claim 1, wherein:

said fixture hangers have a hollow interior in which electrical conductors are routed to provide electrical power to said lighting elements.

29. A lighting system as set forth in claim 1, wherein:

said fixture supports are provided with downwardly extending notches adjacent upper marginal portions of said fixture supports wherein a portion of said cover is closely received to connect said cover with said fixture supports without separate fasteners.

30. A lighting system as set forth in claim 1, wherein:

said structural elements include at least two rods extending longitudinally and juxtaposed about said lighting elements.

31. A. method for making linear ambient lighting on-site for open building plans and the like, comprising:

providing a plurality of elongated lighting elements having electrical connectors positioned adjacent opposite ends thereof;

providing a plurality of electrical power sockets shaped to receive the opposite ends of the lighting elements therein to physically support the same and electrically connect with the electrical connectors to supply electrical power to the lighting elements;

providing a plurality of fixture supports shaped for connection with the electrical power sockets and configured to be spaced longitudinally along the length of an associated lighting fixture;

providing a plurality of structural supports extending between and connecting the fixture supports;

providing a plurality of fixture hangers having first portions adapted to connect with an overhead support portion of an associated building and second portion adapted to connect with and support the fixture support;

connecting the first portions of the fixture hangers to an overhead portion of an associated building in a mutually linear relationship;

mounting the fixture supports on the second portions of the hangers;

assembling the electrical power sockets on the opposite ends of lighting elements to define light assemblies;

positioning the light assemblies between laterally adjacent pairs of the fixture supports and connecting the same thereto;

constructing at the associated building an elongated cover having a selected length that extends continuously along the entire length of the lighting fixture; and covering the lighting fixture with the cover such that the cover is attached to the light fixture below a lowermost portion thereof thereby defining a rigid lightweight assembly that has a neat, custom one-piece appearance and is fabricated on-site at the associated building to alleviate transportation damage and cost.

32. A method for making linear ambient lighting on-site for open building plans and the like, comprising:

providing a plurality of elongated lighting elements having electrical connectors positioned adjacent opposite ends thereof;

providing a plurality of electrical power sockets shaped to receive the opposite ends of the lighting elements therein to physically support the same and electrically connect with the electrical connectors to supply electrical power to the lighting elements;

providing a plurality of fixture supports shaped for connection with the electrical power sockets and configured to be spaced longitudinally along the length of an associated lighting fixture;

providing a plurality of structural supports extending between and connecting the fixture supports including attaching a plurality of connecting rods such that the connecting rods extend between and connect the fixture supports and are substantially juxtaposed about the lighting elements;

providing a plurality of fixture hangers having first portions adapted to connect with an overhead support portion of an associated building and second portion adapted to connect with and support the fixture support;

connecting the first portions of the fixture hangers to an overhead portion of an associated building in a mutually linear relationship;

mounting the fixture supports on the second portions of the hangers;

assembling the electrical power sockets on the opposite ends of lighting elements to define light assemblies;

positioning the light assemblies between laterally adjacent pairs of the fixture supports and connecting the same thereto;

constructing at the associated building an elongated cover having a selected length that extends continuously along the entire length of the lighting fixture; and covering the lighting fixture with the cover such that the cover is attached to the light fixture below a lowermost portion thereof thereby defining a rigid lightweight assembly that has a neat, custom one-piece appearance and is fabricated on-site at the associated building to alleviate transportation damage and cost.

33. A method as set forth in claim 32, further comprising:

providing a reflector between the cover and the lighting elements.

34. A method as set forth in claim 33, wherein:

said cover constructing step includes cutting the cover from a flexible material.

35. A method as set forth in claim 34, wherein:

said cover attaching step includes applying an adhesive to said cover and securing said cover to the connecting rods.

36. A method as set forth in claim 37, wherein:

said cover constructing step includes constructing the cover from a semi-rigid material.

37. A method as set forth in claim 36, wherein:

said cover constructing step includes cutting the cover from a single piece of plastic mesh.

38. A method as set forth in claim 36, wherein:

said cover constructing step includes cutting the cover from a single piece of wire mesh.

39. A method as set forth in claim 33, wherein:

said cover constructing step includes roll forming the cover from a single coiled strip of sheet metal.

40. A method as set forth in claim 32, wherein:

said cover constructing step includes roll forming the cover from a single coiled strip of sheet metal having at least one reflective side.

41. A kit for covering existing linear lighting systems, comprising:

a plurality of suspended fixture supports adapted to connect with and support electrical power sockets normally associated with linear lighting fixtures, said fixture supports adapted to be spaced longitudinally along the length of an associated lighting fixture;

at least two structural support bars extending between and substantially juxtaposed about said fixture supports;

a plurality of fixture hangers having first portions thereof adapted to be connected with an overhead support portion of an associated building and second portions thereof adapted to be connected with and support said fixture supports;

an elongated cover adapted to connect with said lighting fixture, said cover including opposite side edges which are laterally spaced apart when said cover is connected to said support bars to define an upwardly opening window through which light from said lighting elements is emitted from said lighting fixtures, said having an uninterrupted one-piece construction constructed on-site having a selected length that extends continuously along the entire length of said lighting fixture; and connectors adapted to attach said cover to at least one of a group consisting of said fixture supports and said structural support bars, thereby defining a rigid lightweight assembly that has a neat, custom one-piece appearance.

42. A lighting kit as set forth in claim 41, including:

a reflector adapted to be positioned between said cover and said lighting elements.

43. A lighting kit as set forth in claim 41, wherein:

said cover is provided an upper reflective surface.

44. A lighting kit as set forth in claim 41, wherein:

a plurality of end caps are adapted to be mounted on and enclose opposite ends of said lighting fixture.

45. A lighting kit as set forth in claim 41, wherein:

said hangers have a hollow interior adapted to route electrical conductors therethrough to provide electrical power to said lighting elements.

* * * * *

UNITED STATES PATENT AND TRADEMARK OFFICE

CERTIFICATE OF CORRECTION

PATENT NO. : 6,186,642 B1
DATED : February 13, 2001
INVENTOR(S) : Sean M. Corcorran et al.

It is certified that error appears in the above-identified patent and that said Letters Patent is hereby corrected as shown below:

Column 5,
Line 60, "mount" should be -- mounting --.

Column 12, claim 36,
Line 1, "claim 37" should be -- claim 33 --;

Column 12, claim 41,
Line 36, before "having an uninterrupted" insert -- cover --.

Signed and Sealed this

Sixth Day of November, 2001

*Attest:*

Nicholas P. Godici

NICHOLAS P. GODICI
*Acting Director of the United States Patent and Trademark Office*

*Attesting Officer*